United States Patent [19]

Takagi

[11] 4,154,051

[45] May 15, 1979

[54] APPARATUS FOR MANUFACTURING THREE-DIMENSIONED CRIMP FILAMENT

[76] Inventor: Sadaaki Takagi, 39, Mikage-cho, Okazaki-shi, Aichi-ken, Japan

[21] Appl. No.: 799,180

[22] Filed: May 23, 1977

[30] Foreign Application Priority Data

May 25, 1976 [JP] Japan ..... 51-60297

[51] Int. Cl.[2] ..... D02G 1/02; D02G 1/04

[52] U.S. Cl. ..... 57/284; 57/282; 57/332

[58] Field of Search ..... 57/34 HS, 77.3, 77.4, 57/77.42, 77.45, 157 TS

[56] References Cited

U.S. PATENT DOCUMENTS

| | | | |
|---|---|---|---|
| 2,959,906 | 11/1960 | Richter | 57/34 HS |
| 3,034,277 | 5/1962 | Richter | 57/77.3 |
| 3,328,950 | 7/1967 | Scragg et al. | 57/77.45 X |
| 3,525,205 | 8/1970 | Antoni et al. | 57/34 HS |
| 3,774,384 | 11/1973 | Richter | 57/34 HS |
| 3,777,469 | 12/1973 | Spurgeon | 57/34 HS X |
| 3,831,365 | 8/1974 | Smith | 57/34 HS X |

*Primary Examiner*—John Petrakes
*Attorney, Agent, or Firm*—Gordon W. Hueschen

[57] ABSTRACT

An apparatus for manufacturing a three-dimensioned crimp filament comprising: a drive means for pulling filaments; a group of guide rollers arranged in a reverse U-shaped roller group, said roller group being provided ahead of said drive means and adapted to be rotated about a longitudinal axis such as to give forward and rearward portions of a plurality of filaments while stretched with a single twist formed thereon and being transferred by said drive means mutually opposite twisting actions; a pair of rotative rollers each provided with a groove, said roller pair being provided immediately after the roller at the forward end in said roller group and provided with a non-slip means for pulling the single twisted forward portion of said filaments at a transfer speed such that the filaments of said forward portion form into a double twist and are cooled sufficiently to effect a thermal set; a heating means provided ahead of said roller group and serving to heat the filaments formed with a double twist; a single twist transfer roller group provided ahead of said heating means and consisting of a plurality of rollers and given a predetermined rotational tension for guiding filaments formed with a single twist; and a means for stopping spread of double twist, said stopping means being provided on the last roller in said roller group.

10 Claims, 5 Drawing Figures

APPARATUS FOR MANUFACTURING THREE-DIMENSIONED CRIMP FILAMENT

This invention relates to an apparatus for manufacturing three-dimensioned crimp filament and, more particularly, to an apparatus for manufacturing three-dimensioned crimp filament of a synthetic fiber used as a raw material of lock material for cushioning material.

Hitherto, filaments have usually been in the two-dimensioned form, and no substantial increase of the repulsive elasticity or improvement of the cushioning property has been obtained even if intersections of filaments are locked with an adhesive. In addition, if it is intended to form three-dimensioned crimp, it is likely that the curl is chiefly formed only about a portion as a core so that desired three-dimensioned crimp effect cannot be obtained. Further, with the prior-art curl forming apparatus where temporary curing is made, the total denier is limited to 2,000 denier at the most in view of the mechanism, so that only small curls can be obtained.

In order to improve the above various drawbacks in the prior-art apparatus there has been proposed an apparatus for continuously manufacturing thick synthetic fiber crimped staples of several hundred denier as a single yarn for cushioning, which is provided with a heating means for effecting wet heating immediately before processing and a temporary twisting heating means for effecting two continuous twists on rope consisting of an ordinary primary twist and a secondary fist twist, and in which thermoplastic filaments are given double helical crimps which are thermally set by strong heating means provided between the afore-mentioned means and then subjected to releasing of the temporary twists and then cutting by a cutting means (Japanese Utility Model Publication No. 40402/74). This apparatus, however, has a drawback in that it is difficult to prevent spread of the fist twist formed in the secondary fist twist process to the ordinary primary twist process.

An object of the present invention, accordingly, is to provide an apparatus for manufacturing three-dimensioned crimp which is capable of giving fiber filaments crimps having three-dimensioned directivity, that is, three-dimensioned crimp, greatly contributing to the increase of repulsive elasticity and improvement of cushioning property when the filaments are made as lock material or contained within a cushioning material.

Another object of the present invention is to provide an apparatus for three-dimensioned crimp filament, which can greatly contribute to the increase of the repulsive elasticity by forming large crimp with increase of the total denier.

These objects are achieved by an apparatus comprising a drive means for pulling filaments, a group of guide rollers positioning in a reverse U-shaped roller group, said roller group being provided ahead of said drive means and adapted to be rotated so as to give forward and rearward portions of a plurality of filaments which stretched with a single twist formed thereon and being transferred by said drive means, mutually opposite twisting actions, a pair of rotative rollers each provided with a groove, said roller pair being provided immediately after the roller at the forward end in said roller group and provided with a non-slip means for pulling the single twisted forward portion said filaments at a transfer speed such that the filaments of said forward portion formed into a double twist and are cooled sufficiently to effect a thermal set, a heating means provided ahead of said roller group and serving to heat the filaments formed with a double twist, a single twist transfer roller group provided ahead of said heating means and consisting of a plurality of rollers for giving the filaments and given a predetermined rotational tension for guiding filaments formed with a single twist, and a means for stopping spread of double twist, said stopping means being provided on the last roller in said roller group.

The filaments used in accordance with the invention may be such synthetic fiber as polyester, polyamide, polyacrylonitrile, polypropylene, polyvinylidene chloride, vinylon and so forth and natural fiber, but synthetic fibers, amongst them polyester fiber, are preferred. The polyester fiber filaments are superior in rigidity to other synthetic fibers and also have high repulsive elasticity, so that when used for cushion in the form of a locked material very satisfactory cushioning property can be obtained. Thus, the filaments used according to the invention are preferably of 50–2,000 denier, more preferably of 300–500 denier.

The three-dimensioned crimp filament obtained according to the invention may be subjected to improvement of the cushioning property and rigidity after refinement by solely filling it into a cushion or formed into a locked material by locking the intersections of the filaments with an adhesive into a predetermined form. This locked material may be used solely as the cushion or incorporated in another cushion for improving the cushioning property and rigidity.

The term "two-dimensioned crimp" throughout the specification refers to what is regularly crimped in the form of a wave, and the term "three-dimensioned crimp" refers to what is obtained by providing an additional crimp to this wave state.

The present invention will be understood best in conjunction with the accompanying drawings, in which.

Figure 1:
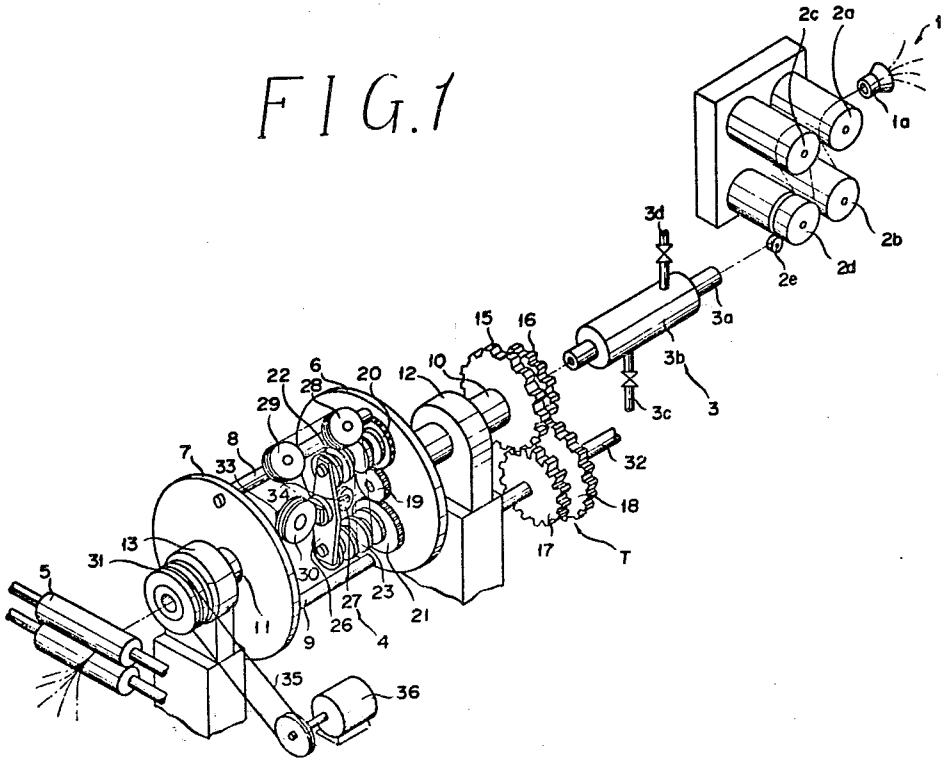
FIG. 1 is a perspective view of the apparatus in accordance with the present invention.
Figure 2:
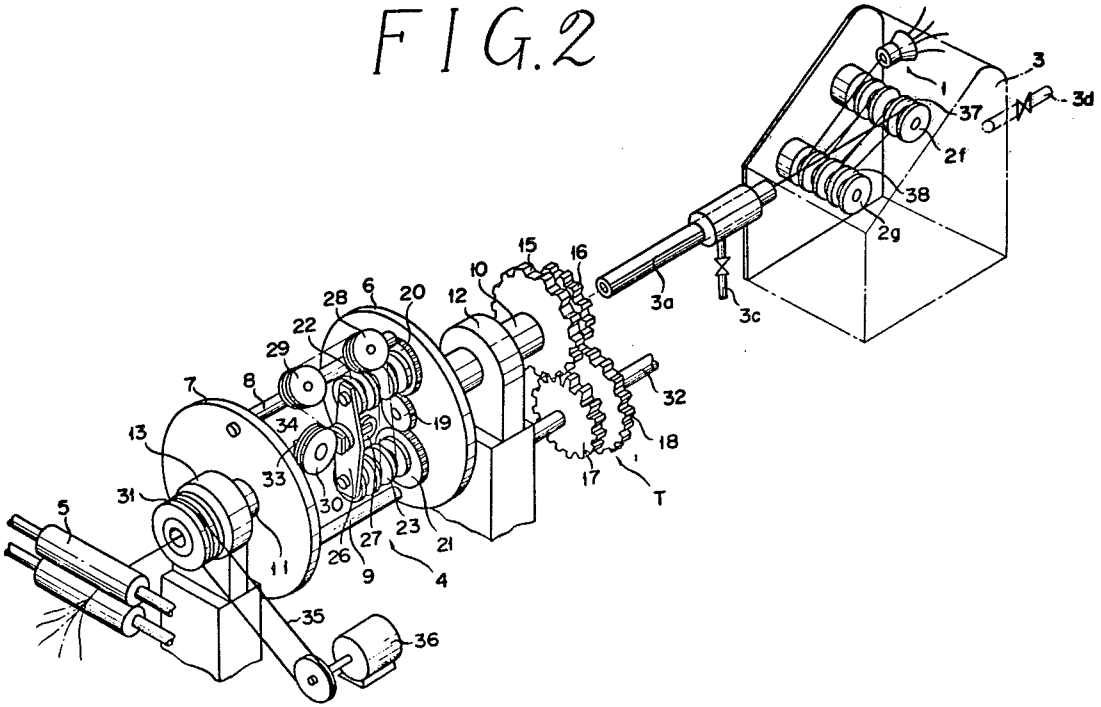
FIG. 2 is a perspective view of another embodiment of the apparatus in accordance with the present invention.
Figure 3:
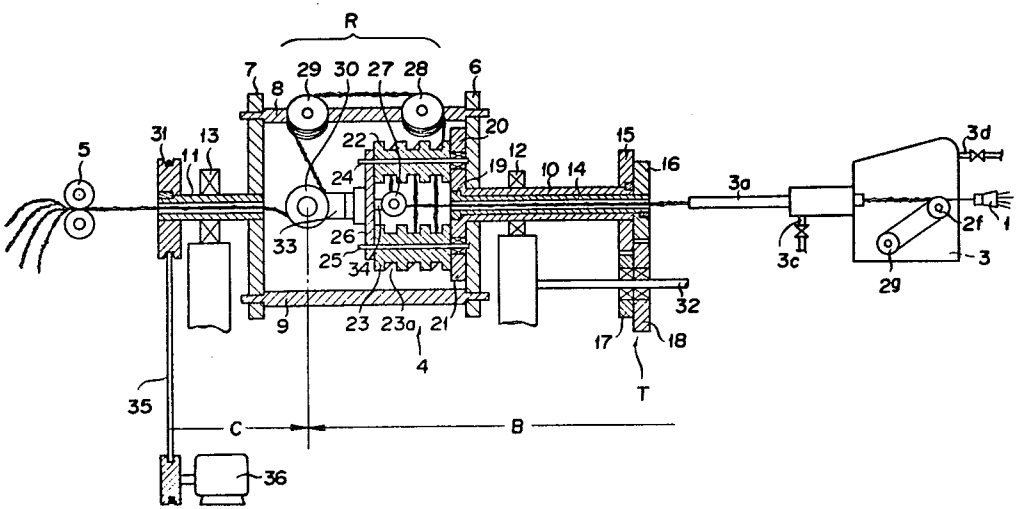
FIG. 3 is a sectional view of the apparatus in accordance with the present invention.

As shown in FIGS. 1 to 3, a filament supply inlet 1, a single twist transfer roller group 2, a heating means 3, a twisting means 4 and tension drive rollers 5 are disposed in the mentioned order in the direction of feed of a filament. These individual parts will now be described in detail.

The filament supply inlet 1 has a tapered form and has a projected tip 1*a* serving to bundle the filament F.

The roller group 2 includes four rollers 2*a*, 2*b*, 2*c* and 2*d* provided with a predetermined tension. The last roller 2*d* has a groove of a width slightly greater than the diameter of the double twist to be formed for preventing the filaments from going from single twist to double twist and, if desired, is provided with a keep roller 2*e* of a width smaller than the width of the groove. That is to say, if a diameter of the roller 2*d* is small, the keep roller 2*e* is not necessary, while if it is large, it is preferable to provide the roller 2*e*. These rollers 2a, 2b, 2c and 2d are not necessarily a driving means and are principally free rotative rollers.

The roller group 2 may be rollers 2f and 2g having respectively several grooves 37 and 38 as shown in FIG. 2. In this case, the last groove, that is to say, the one in roller 2f corresponding roller 2d in FIG. 1 has a width slightly greater than diameter of the double twist to be formed for preventing the filaments from going from single twist to double twist.

The heating means 3 includes a pipe 3a through which the filaments formed with double twist are passed, a jacket 3b on the outer side of the pipe 3a, a duct 3c for introducing high pressure steam into the jacket 3b, and an exhaust duct 3d. Inner diameter of the pipe 3a is slightly greater than that of double twist filament. Further, the filament supply inlet 1, the roller group 2 and a part of double twisted filament may be arranged correctively in the heating means 3 and good results can be obtained with such arrangement. And as the heating means 3 one may use electric heating, infrared rays, high frequency heating and so forth as well.

The twisting means 4 has two rotative discs 6 and 7 coupled together with two arms 8 and 9. The rotative discs 6 and 7 are provided at their center with respective hollow shafts 10 and 11. The shafts 10 and 11 are supported by respective bearings 12 and 13. A hollow shaft 14 for introducing the filaments is rotatably fitted in the interior of the shaft 10 on the side of filament introduction. The shaft 10 and hollow shaft 14 are provided at their ends with respective spur gears 15 and 16. These spur gears 15 and 16 are in mesh with respective spur gears 17 and 18 coaxially secured to a shaft 32 extending below them. These gears constitute a gear train. The hollow shaft 14 is provided at its other end on the side of the disc 6 with a sun gear 19 in mesh with planet gears 20 and 21 revolving therearound. Pair rollers 22 and 23 provided with rotary grooves are coupled via respective fixed shafts 24 and 25 to the planet gears 20 and 21. The rollers 22 and 23 are provided with respective grooves 22a and 23a such as to maintain proper transfer speed for forming the filament with double twist and sufficient cooling period to effect thermal set. The grooves 22a and 23a have wavy sectional profile such as to permit the filament formed with double twist to be pulled without causing slip. The ends of the fixed shafts 24 and 25 are coupled together by means of a bracket 26. Guide rollers 27 and 30 are provided via brackets 33 and 34 to the opposite sides of the center portion of the bracket 26. The arm 8 is provided with guide rollers 28 and 29 constituting with guide rollers 27 and 30 a guide roller group R arranged in a reverse U-shaped roller group in order to give a twisting action on the feed-in side and an untwisting action on the feed-out side. The shaft 11 is provided at the end thereof with a drive pulley 31 secured thereto and coupled via a belt or chain to a power source 36.

The method of manufacture of the above apparatus by using a three-dimensioned crimp filament block will now be described.

A plurality of filaments, for instance, synthetic fiber filaments, pulled out from a plurality of bobbins (not shown) are passed through the filament supply inlet 1, passed round the four rollers 2a, 2b, 2c and 2d in the single twist transfer roller group 2 such that they form two S-shaped curves, passed through the pipe 3a of the heating means and through the hollow shaft 14, and passed around the guide roller 27 and around the rollers 22 and 23 with the respectively rotary grooves in the mentioned order, and then they are passed round the guide rollers 28, 29 and 30, passed through the shaft 11 and passed between the drive rollers 5. Instead of the drive rollers 5, a rotary cutter having a torque motor may be used and a greater effect can be obtained.

Figure 4:
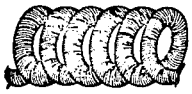
FIG. 4 is a perspective view of a filament means having double twist.

Alternatively, a plurality of filaments F are bundled approximately uniformly and are passed around the rotative free rollers 2f and 2g having grooves repeatedly for four times. These rotative free rollers having grooves stop the spread of double twist as shown in FIG. 4 which as rotation of the twisting means spreads rearwards and prevents it from going backwards beyond these grooved rollers. Another important point is that these rollers operate to feed the necessary amount of filament without excessive tension. Further they feed the filament so as to be twisted uniformly. The reason why the filaments are passed repeatedly for two or three times is to prevent the spread of the twist (double and single twist) rearwards. This effect is caused by the friction between the filament and the rollers in both the upper and lower grooved rollers and the twisting stress caused by the fact that the length of the filament shortens to one fourth when the filament is twisted compared to an untwisted one. However, there is little tension at a twisted part. Therefore, the double twisted filament is not loaded unusually, so it is easily untwisted and the filament is not injured.

Double twisted shape which is shaped continuously at the last groove of the roller group 2 is heated through the wet heating pipe 3a.

Then, a motor 36 is driven to cause rotation of a pulley 31 in the clockwise direction so as to rotate the rotative discs 6 and 7 in the clockwise direction. As a result, the shaft 10 secured to the rotative disc 6 and the gear 15 coaxially secured to the shaft are rotated in the clockwise direction. Since the gear 17 in mesh with the gear 15 is rotated in the counterclockwise direction, thus causing rotation of the gear 18 in the same direction as the gear 17, the gear 16 and shaft 14 secured to the shaft are rotated in the clockwise direction. Further, a sun gear 19 secured to the hollow shaft 14 is rotated in the clockwise direction similar to the rotative disc, but at a different rotational speed. With the rotation of the sun gear 19 the planet gears 20 and 21 are rotated in the opposite direction. Consequently, an action of mutual twisting of a plurality of filaments F in the opposite direction is produced before and after the guide roller group R.

When the filament passes through the twisting means 4 a and is given twisting force by passing it through a passage formed by the reverse U-shaped roller group, the filament is twisted at the first corner machine causes an effect to restore twist after twisting.

The feeding force applied in the direction of forward movement by the feeding rollers 22 and 23 can be changed by changing the rate of rotation of gear 16 based on the gear ratio of the four gears. Therefore, total thickness and creation of uniform double twist are controlled by feeding and rotation ratio. Rotation of gear 16 is the same as rotation of the sun gear 19, and difference of rotation from rotation discs 7 and 6 affects rotation of filament feeding rollers 22 and 23 in the rotation machine. The feeding rate of the filament is controlled by combination of the four gears. The filaments F provided with double twist are heated by the heating means 3 and are adapted to be pulled by the pair of grooved rollers 22 and 23 as they are cooled down so that thermal set is completed by the time they are transfered by the roller 30.

Then, on the rear side of the roller 30 the filaments receive twisting action in the reverse direction, whereby a double twist release section C is formed. In other words, since the filaments are pulled by the pulling drive roller 5, they are transferred as the double twist on them is released and are cut to a desired size by means of a roller cutter (not shown), whereby three-dimensional crimp filament block is formed.

EXAMPLE

Figure 5:
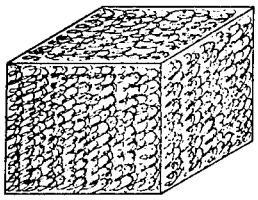
FIG. 5 is a perspective view of a locked material using three-dimensioned crimp filament block.

A three-dimensioned crimp filament block was formed under the following condition, and a block of locked material as shown in FIG. 5 was formed as shown in FIG. 5 from this crimp filament. Its physical property values were as follows.

Material: Polyester filament
Monodenier: 300 denier
Total denier: 500,000 denier
Transfer speed of filaments in double twist section: 2.7 m/min.
Thermal set temperature: 120° to 130° C.

The three-dimensioned crimp filament formed in this way was formed into a mass of a predetermined shape and size block while sprinkling an adhesive over it, thereby obtaining a block of locked material. The specific gravity of the block of locked material was $5.00\times10^{-3}$. Results of test conducted on a test piece with a dimension of 200 mm by 150 mm are as follows.

ILD 25% = 15.8
ILD 65% = 37.5
Sag-factor = 2.37
Repetitive permanent distortion test = below 1%

The ILD 25% here represents a stress (kg) for 20 second obtained when the test piece is compressed on a disc 150 mm in diameter from thereabove with a compression speed of 10 mm/sec and the compression is stopped after the compression is proceeded to 25%, and ILD 65% similarly represents a stress (kg) when the compression is made to an extent of 65%. The ILD means the magnitude of the repulsive elasticity. The sag-factor represents rigidity represented by (ILD 65 5)/(ILD 25%). Usually, the sag-factor is desirably as close to 2.6 as possible.

For the numerical value (%) of the repetitive compression permanent distortion, the afore-mentioned test piece is sandwiched between parallel flat plates after measuring the thickness of the test piece, it is compressed repeatedly and continuously for 80,000 times at a normal temperature and at a rate of 60 times per minute to reduce its thickness to 50%, then it is taken out and left for 30 minutes, its thickness is then measured, and the permanent distortion is calculated from the following equation. The lower one of the parallel plates for compression is provided with holes 6.3 mm in diameter at an interval of 20 mm.

Repetitive compression permanent distortion $=(t_o-t)/t_o\times100(\%)$
$t_o$ = thickness before test
$t$ = thickness after test As the cushioning material for an automotive sheet a repetitive compression permanent distortion of 3% or below is required.

Since the invention has the above construction, it is possible to obtain a three-dimensioned crimp filament block with great extent of curl, which has such effects as permitting increase of the total denier quantity, increase of the repulsive elasticity when it is used as locked material or contained within a cushioning material, improvement of the cushioning property and extreme reduction of the permanent distortion with respect to use for a long period.

What is claimed is:

1. An apparatus for manufacturing a three-dimensioned crimp filament comprising:
   - a drive means for pulling filaments along a filament pathway having forward and rearward portions aligned in a common axis;
   - a group of guide rollers arranged in a reverse U-shaped roller group, said roller group being located ahead of said drive means and being adapted to be rotated as a unit about said common axes in order to give forward and rearward portions of a plurality of filaments stretched along said pathway and transferred by said drive means, initially with a single twist formed thereon, mutually opposite twisting actions;
   - a pair of rotative, grooved, non-slip rollers located immediately after the roller at the forward end in said reverse U-shaped roller group and adapted to rotate individually about longitudinal axes parallel with said common axis with one axis diametrically opposed to the other and as a unit with said reverse U-shaped roller group, said pair of rollers functioning to pull and simultaneously twist said filaments initially formed with a single twist at a rate which causes the filaments to form into a double twist;
   - a heating means provided ahead of said roller group and serving to heat the filaments formed with a double twist to a temperature such that on cooling the crimp of the filament is given a permanent set, the residence time of said heated filament in passing over the rollers of said pair of rollers and of said reverse U-shaped roller group being sufficient to cool the heated filament enough to effect said thermal set;
   - a single twist transfer roller group provided ahead of said heating means and consisting of a plurality of rollers and given a predetermined rotational tension for guiding filaments formed with a single twist; and
   - a means on the last roller in said single twist roller group for stopping spread of double twist into said single twist transfer roller group.

2. An apparatus according to claim 1, wherein said single twist transfer roller group consists of a plurality of rollers given with a predetermined tension, the last one of said rollers being provided with a circumferential groove of a width slightly greater than the diameter of the double twist formed on the filaments.

3. An apparatus according to claim 1, wherein said single twist transfer roller group consists of a plurality of rollers respectively provided with a plurality of circumferential grooves.

4. An apparatus according to claim 1, wherein said pair of non-slip rollers are affixed to planet gears driven by a sun gear of a planetary gear means.

5. An apparatus according to claim 4, wherein said planet gears are rotatively mounted on a rotative disc adapted to rotate about said common axis and wherein the sun gear of said planetary gear means is mounted to rotate coaxially with said rotative disc which in turn is coupled to a power source, said sun gear being rotated at a rotational speed different from that of said disc through speed change means operative on rotation of said disc.

6. An apparatus according to claim 5, wherein said speed change means includes a tubular shaft secured to said rotative disc, a first gear secured to said tubular shaft, a second gear in mesh with said first gear, a third gear adapted to rotate in unison with said second gear but having a different number of teeth, and a fourth gear in mesh with said third gear and secured to another tubular shaft provided within said first-mentioned tubular shaft rotatively connecting said sun gear and said fourth gear.

7. An apparatus according to claim 1, wherein said reverse U-shaped roller group comprises guide rollers mounted on an arm which is axially displaced from and parallel to said common axis and extends between two rotative discs mounted to rotate about said common axis and on brackets adapted to be rotated in unison with said discs and substantially in said common axis.

8. An apparatus according to claim 7, wherein said pair of non-slip rollers are mounted on planet gears rotatively mounted on the rearward one of said discs and project axially therefrom toward the other said disc and parallel to both said arm and said common axis between a guide roller mounted on the rearward side of said bracket and a guide roller mounted on the rearward end of said arm.

9. An apparatus according to claim 8, in which said planet gears are driven by a sun gear which, in turn, is driven by said rotative discs through speed change means which causes said sun gear to rotate in the same direction as said rotative discs but at a different speed, whereby said pair of non-slip rollers rotate in a direction opposite to the direction of rotation of said discs.

10. A filament treating and setting apparatus which comprises means for continuously feeding and continuously pulling a continuous filament bundle in a pathway comprising a rearward linear portion, a forward linear portion aligned with said rearward linear portion on a common axis, and a reverse U-shaped portion between said rearward and forward portions, means for causing said intermediate portion to rotate about said common axis, whereby said filament bundle is twisted in said rearward portion and untwisted in said forward portion, the rotation of said reverse U-shaped portion being so correlated with the tension of said rearward portion that a double twist is formed in said rearward portion, means for stopping said double twist from going rearward beyond said rearward portion, pulling means comprised in said reverse U-shaped portion for pulling the double twisted filament bundle at a rate to maintain the double twist, and heating means rearward of said pulling means for heating the double twisted filament bundle, said reverse U-shaped portion and said pulling means functioning to extend the travel time of said heated double twisted filament bundle sufficient for it to cool enough to effect a permanent set before it passes on into said forward portion where it is untwisted.

* * * * *

UNITED STATES PATENT AND TRADEMARK OFFICE

CERTIFICATE OF CORRECTION

PATENT NO. : 4,154,051

DATED : May 15, 1979

INVENTOR(S) : Takagi

It is certified that error appears in the above-identified patent and that said Letters Patent are hereby corrected as shown below:

Col. 2, line 58; "filament F." should read -- filaments F. --

Col. 4, line 23; "one fourth" should read -- one-fourth --

Col. 4, line 51; "4 a and is given twisting" should read -- 4 and is given a twisting --

Col. 4, lines 53 & 54; delete "machine causes an effect to restore twist after twisting."

Col. 5, line 27; "block" should read -- (block) --

Col. 5, lines 61 & 62 "$(t_o - t)-/t_o \times 100(\%)$" should read -- $\frac{t_o - t}{t_o} \times 100(\%)$ --

Signed and Sealed this

*Eighteenth* Day of *September 1979*

[SEAL]

*Attest:*

*Attesting Officer*

LUTRELLE F. PARKER

*Acting Commissioner of Patents and Trademarks*